US011073004B2

(12) United States Patent
Greci et al.

(10) Patent No.: US 11,073,004 B2
(45) Date of Patent: Jul. 27, 2021

(54) WELL SCREEN ASSEMBLY WITH EXTENDING SCREEN

(71) Applicant: Halliburton Energy Services, Inc., Houston, TX (US)

(72) Inventors: Stephen Michael Greci, McKinney, TX (US); Matthew Franklin, Lewisville, TX (US); James J. Kang, Dallas, TX (US); Aaron James Bonner, Flower Mound, TX (US); Luke William Holderman, Plano, TX (US); Jean-Marc Lopez, Plano, TX (US); Liang Zhao, Carrollton, TX (US); Michael Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/275,843

(22) Filed: Feb. 14, 2019

(65) Prior Publication Data

US 2019/0178063 A1 Jun. 13, 2019

Related U.S. Application Data

(63) Continuation of application No. 14/776,009, filed as application No. PCT/US2013/034843 on Apr. 1, 2013, now abandoned.

(51) Int. Cl.
*E21B 43/10* (2006.01)
*E21B 43/08* (2006.01)

(52) U.S. Cl.
CPC ..... *E21B 43/108* (2013.01); *E21B 43/08* (2013.01); *E21B 43/103* (2013.01); *E21B 43/105* (2013.01)

(58) Field of Classification Search
CPC ..... E21B 43/108; E21B 43/08; E21B 43/103; E21B 43/105; E21B 43/082; E21B 43/086; E21B 43/088; E21B 43/10; E21B 43/048; B01D 39/00–2096
See application file for complete search history.

(56) References Cited

U.S. PATENT DOCUMENTS

| | | | |
|---|---|---|---|
| 3,028,915 | A | 4/1962 | Jennings |
| 4,200,150 | A | 4/1980 | Saadeh et al. |
| 4,722,400 | A | 2/1988 | Burns |
| 5,868,200 | A | 2/1999 | Bryant et al. |
| 5,980,533 | A | 11/1999 | Holman |
| 6,263,966 | B1 | 7/2001 | Haut |
| 6,415,509 | B1 | 7/2002 | Echols |
| 6,732,806 | B2 | 5/2004 | Mauldin et al. |
| 6,742,598 | B2 | 6/2004 | Whitelaw et al. |
| 6,752,207 | B2 | 6/2004 | Danos et al. |
| 6,799,686 | B2 | 10/2004 | Echols |
| 6,994,170 | B2 | 2/2006 | Echols |

(Continued)

FOREIGN PATENT DOCUMENTS

| | | |
|---|---|---|
| GB | 2354271 A | 3/2001 |
| GB | 2496957 A | 5/2013 |

*Primary Examiner* — George S Gray
(74) *Attorney, Agent, or Firm* — Scott Richardson; Parker Justiss, P.C.

(57) ABSTRACT

A well screen assembly residing in a well bore has a base pipe and a filtration screen carried on the base pipe. The screen is radially extended with force from fluid while maintaining the base pipe radially unextended.

19 Claims, 7 Drawing Sheets

(56) References Cited

U.S. PATENT DOCUMENTS

| | | | | |
|---|---|---|---|---|
| 7,048,048 | B2 | 5/2006 | Nguyen et al. | |
| 7,066,271 | B2 | 6/2006 | Chen et al. | |
| 7,134,501 | B2 | 11/2006 | Johnson et al. | |
| 7,204,316 | B2 | 4/2007 | Dusterhoft et al. | |
| 7,380,595 | B2 | 6/2008 | Wetzel et al. | |
| 7,407,013 | B2 | 8/2008 | Whitsitt | |
| 7,866,383 | B2 | 1/2011 | Dusterhoft et al. | |
| 7,926,565 | B2 | 4/2011 | Duan et al. | |
| 7,980,302 | B2 | 7/2011 | Ring et al. | |
| 8,006,771 | B2 | 8/2011 | Green et al. | |
| 8,201,636 | B2 | 6/2012 | Gandikota et al. | |
| 8,579,025 | B2 | 11/2013 | Holderman | |
| 2002/0088744 | A1 | 7/2002 | Echols | |
| 2002/0189821 | A1* | 12/2002 | Watson | E21B 33/127 166/387 |
| 2003/0037932 | A1* | 2/2003 | Guillory | E21B 23/06 166/387 |
| 2004/0003927 | A1 | 1/2004 | Rudd | |
| 2005/0098324 | A1* | 5/2005 | Gano | E21B 34/06 166/384 |
| 2005/0139359 | A1 | 6/2005 | Maurer et al. | |
| 2005/0173109 | A1 | 8/2005 | Cameron | |
| 2010/0000742 | A1 | 1/2010 | Bonner et al. | |
| 2011/0036565 | A1* | 2/2011 | Holderman | E21B 43/103 166/227 |
| 2012/0211223 | A1 | 8/2012 | Guest | |
| 2014/0048279 | A1 | 2/2014 | Holderman | |

* cited by examiner

WELL SCREEN ASSEMBLY WITH EXTENDING SCREEN

CROSS-REFERENCE TO RELATED APPLICATIONS

This Application is a Continuation of application Ser. No. 14/776,009 filed on Sep. 14, 2015, which is a U.S. National Phase Application under 35 U.S.C. § 371 and claims the benefit of priority to International Application Serial No. PCT/US2013/034843, filed on Apr. 1, 2013, the contents of which are hereby incorporated by reference.

BACKGROUND

In a well system, well screen assemblies are used to filter against passage of particulate from the wellbore into the production string. The wellbore around the screens is often packed with gravel to assist in stabilizing the formation and to pre-filter against particulate before the particulate reaches the screens. A uniform gravel packing can, however, be difficult to achieve due to formation of sand bridges and other complications experienced when pumping the gravel slurry into the region around the screens. Therefore, sometimes expandable screens that expand into contact with the wellbore are used in place of gravel packing.

DESCRIPTION OF DRAWINGS

FIGS. 2A and 2C-D are end cross-sectional views of example well screen assemblies shown in a radially compact, unextended, run-in state, with FIG. 2A having a corrugated screen, FIG. 2C having a flat screen with overlapping ends, and FIG. 2D having squat, T-shaped crimps defining corrugations. FIG. 2B shows these example screens in a radially extended state. FIG. 2E is a side, half cross-sectional view of an example well screen assembly with one or more bladders and the well screen assembly shown in a radially compact, unextended run-in state. FIG. 2F shows this screen in a radially extended state.

FIGS. 3A and 3B are a side, half cross-sectional view and an end cross-sectional view, respectively, of an example louver type well screen assembly having a circumferentially corrugated bladder with the well screen assembly shown in a radially compact, unextended, run-in state. The cross section of FIG. 3B is taken through the telescoping passageways. FIG. 3C shows this example well screen assembly in a radially extended state. FIGS. 3F and 3G are end cross-sectional views of an example louver type well screen assembly having an axially corrugated bladder shown in a radially compact, unextended, run-in state and radially extended state, respectively. The cross sections of FIGS. 3F and 3G are taken between the telescoping passageways. FIG. 3D shows a ratchet mechanism, in side half cross-sectional view, that can be used with any of the example louver type well screen assemblies mentioned here. FIG. 3E shows an example hydraulic injection tool used in inflating the bladders.

Like reference symbols in the various drawings indicate like elements.

DETAILED DESCRIPTION

Figure 1:
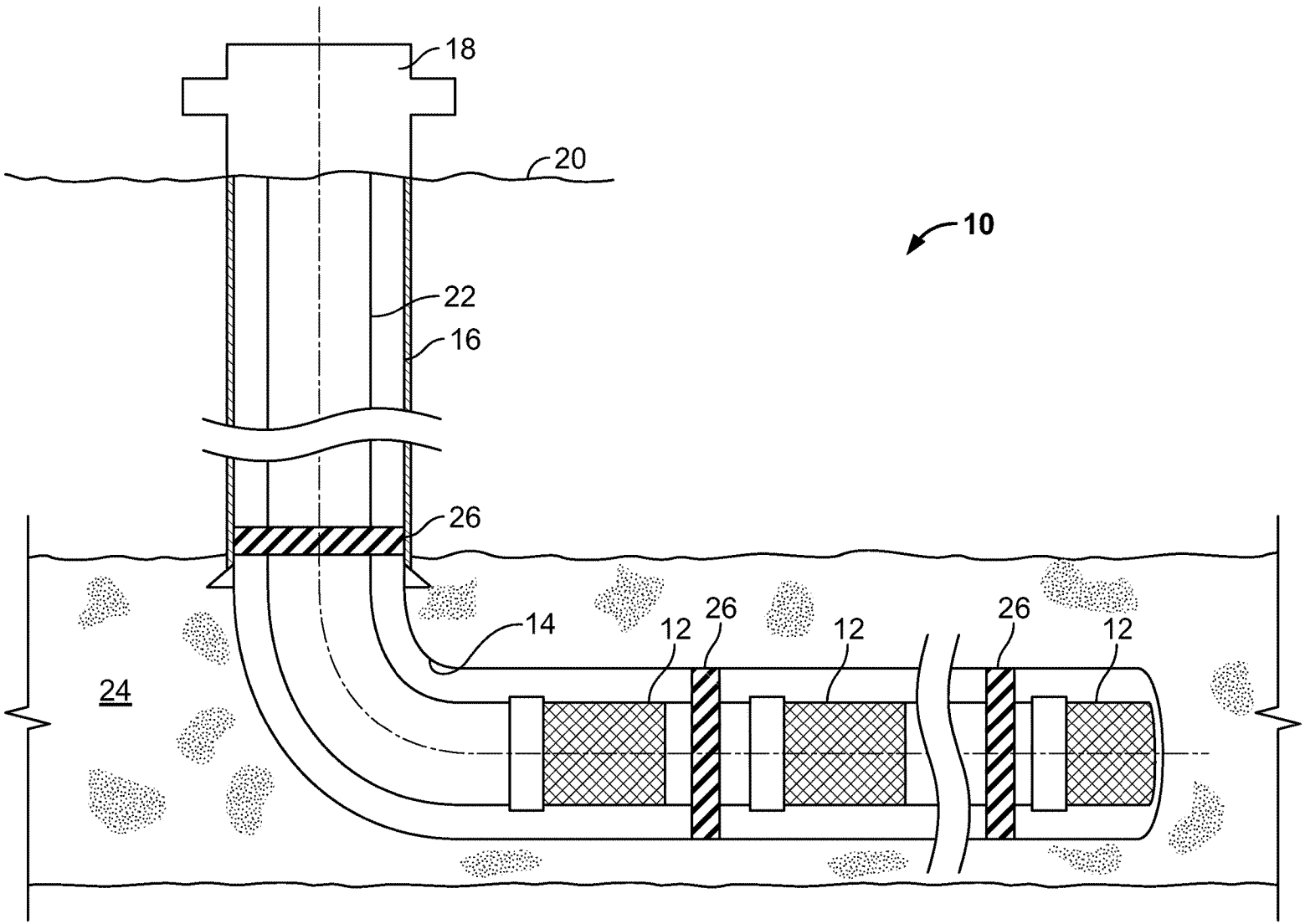
FIG. 1 is a side view of an example well system incorporating a plurality of radially extending well screen assemblies.

Referring first to FIG. 1, an example well system 10 is shown to illustrate an example application of well screen assemblies 24. The well system 10 includes a subterranean wellbore 12 extending from the terranean surface through one or more subterranean zones of interest 20. The subterranean zones 20 can correspond to all or a portion of a subterranean formation (e.g., hydrocarbon bearing formation) and/or multiple formations. The well bore 12 shown in FIG. 1 is a "horizontal" well bore, and has a substantially vertical section 14 and a substantially horizontal section 18. The concepts herein, however, are applicable to many other configurations of well bores, such as vertical wells, slanted wells, other deviated wells, multi-laterals, and/or other configurations. The wellbore 12 can be cased or partially cased. For example, in FIG. 1, the vertical section 14 includes a casing 16 cemented at an upper portion thereof, and the horizontal section 18 is open hole through the subterranean zone 20.

A tubing string 22, for example, a production and/or injection string, resides in the well bore 12 and extends from the terranean surface. The tubing string 22 can communicate fluids between the subterranean zone 20 and the surface. The screen assemblies 24 are distributed along the tubing string 22 proximate the subterranean zone 20. The screen assemblies 24 are sand control screen assemblies that can filter out particulate materials from well fluids, direct the well fluids to a center bore of the tubing string 22, and stabilize the formation. As is discussed in more detail below, the screen assemblies 24 are of a type that radially extend into contact with an interior wall of wellbore 12 and are shown in an operating or a radially extended configuration. Three screen assemblies 24 are shown. In other instances, fewer or more screen assemblies 24 can be used. The screen assemblies may be all of one type or some or all of the screen assemblies 24 can be of a different configuration. In certain instances the screen assemblies 24 are of a type that can be run into the well in a radially compact, unextended run-in state, and subsequently extended using pressure from a fluid supplied into the interior of the screen assembly 200. The fluid can be supplied from the surface via a tubing string of jointed and/or coiled tubing and/or through the wellbore 12 (apart from a tubing). The fluid can alternately or additionally be supplied from a downhole location (e.g., with a pump and/or other).

Figure 2A:
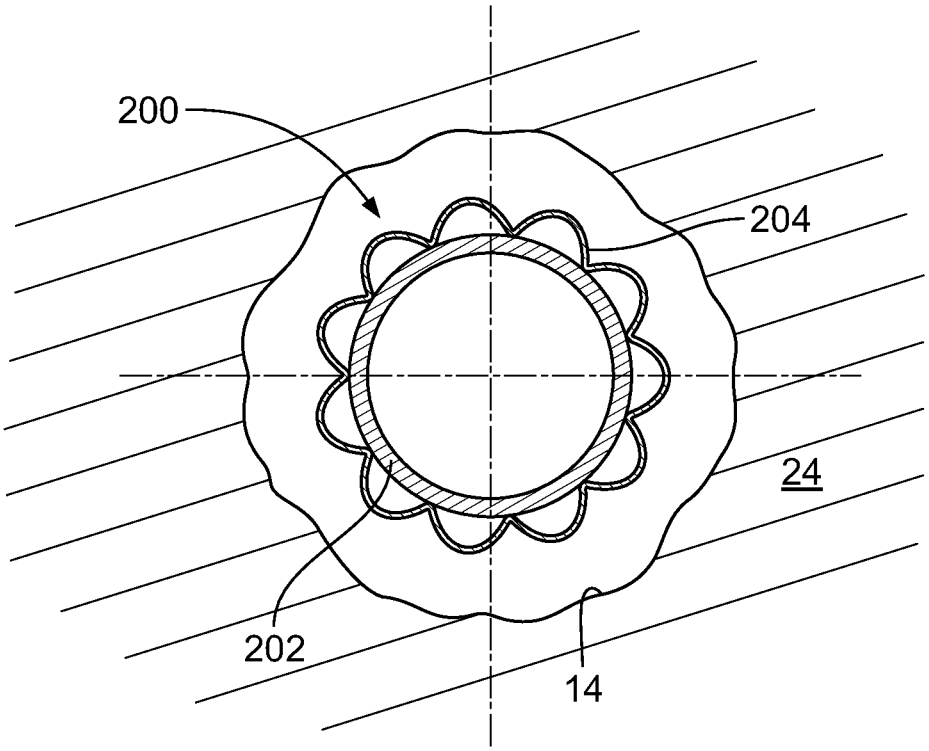
FIGS. 2A-2F are example well screen assemblies having a base pipe encircled by an extendable screen that can be extended radially, and in certain instances, into contact with the wall of the wellbore.

FIGS. 2A-2F are example well screen assemblies having a base pipe encircled by an extendable screen that can be extended radially, and in certain instances, into contact with the wall of the wellbore. FIG. 2A is an end cross-sectional view of an example well screen assembly 200 that can be used as well screen assembly 24. The well screen assembly 200 includes a base pipe 202 encircled by a screen 204, and the screen is sealed to the base pipe 202 at its ends by end rings (like end rings 206 shown in FIG. 2E) affixed to the base pipe 202. The base pipe 202 can be of a type having a plurality of apertures distributed along its length, beneath the screen 204, to allow communication of fluid between an exterior of the screen assembly 200 and the center bore of the base pipe 202 via the screen 204. Alternately, the base pipe 202 can be unaperatured between the end rings, and the end rings can collect and allow flow between the exterior of the well screen assembly 200 and the center bore of the base pipe 202. In certain instances, the end rings can contain an inflow control device, such as valve responsive to a signal or to conditions in the well, a flow orifice of specified flow area, and/or other inflow control devices.

Figure 2B:
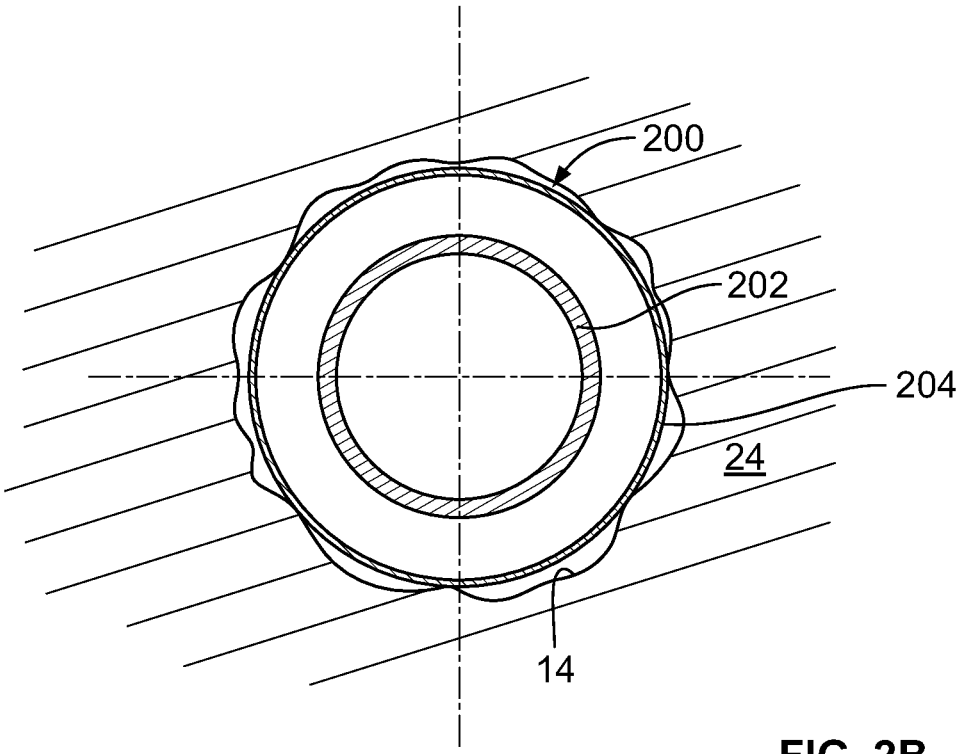

In well screen assembly 200, the screen 204 is corrugated, having been compressed from a fully extended state by providing partial folds in the screen material around the circumference of the base pipe 202. The well screen 204 is shown with folds extending axially. FIG. 2B shows the screen 204 in the fully extended state. In certain instances, the screen 204 in its extended state has a diameter equal to the diameter of the well bore 14.

In certain instances, the screen 204 has a degradable material embedded in its openings, the degradable material sealing against flow through the screen 204. The degradable material is a material that structurally degrades to allow flow through the screen 204 in response to a specified stimulus. The degradable material can be selected to degrade in response to certain fluids (e.g., the actuating fluid and/or another fluid) and/or when exposed to certain conditions, such as a specified temperature and/or pressure (e.g., high temperatures associated with steam injection). The degradable material can degrade by dissolving, corrosion, hydrolytic cleavage, galvanic reactions, melting and/or in another manner. In certain instances, the degradable material can be a plasticized acid coating such as polylactic acid (PLA), polylactic-co-glycolic acid (PLGA), or similar. Other examples of degradable material exist. The degradable materials can be coated, injected, and/or pressed into the screen 204 before assembly or installation in the well, forming a filled non-porous surface. Therefore, with the screen assembly 200 in the wellbore 14 in location, the screen 204 is extended by supplying fluid through the interior center bore of the base pipe 202 at pressure. The screen 204, sealed by the degradable material, defines an inflatable (hydraulically, pneumatically and/or otherwise) fluid cavity between the screen 204 and the base pipe 202 that is filled by the fluid. The fluid acts on the screen 204 extending it into contact with the wall of the wellbore 14. In extending the screen 204, the pressure of the fluid at least partially straightens the corrugations of the screen 204, and may elastically and/or plastically deform the screen 204. In certain instances, as in FIG. 2B, the pressure extends the screen 204 to contact the entire or substantially the entire inner perimeter of the wellbore 14. The base pipe 202, however, is radially unextended, staying generally the same dimensions (save some nominal elastic deformation that may occur when pressure is applied to the screen 204) that it was when it was run into the wellbore 14. The base pipe 202 is not substantially plastically deformed by the fluid.

Alternatively, the openings of the screen 204 can be open (without a degradable material) when the well screen assembly 200 is run into the wellbore 14, and a degradable material pumped into the center bore of the base pipe 202. The degradable material lodges in the openings of the screen 204 sealing against flow through the screen 204 and enables (by defining an inflatable fluid cavity) the fluid pressure to act on and extend the screen 204. In certain instances, the degradable material can be pumped into the well screen assembly 200 concurrently with extending the screen 204 or prior to extending the screen 204, in connection with another operation or apart from another operation.

With the screen 204 extended, the degradable material can be removed. Thus, after the screen 204 has been extended to the wall of the wellbore 14, a fluid that creates the degrading conditions is pumped through the center of the base pipe 202 into the interior of the screen 204 and/or down the annulus between the screen assembly 200 and the wellbore 14 to contact the screen 204. The fluid structurally degrades the degradable material in the openings of the screen 204 and opens the screen to allow flow. After installation of the screen into the wellbore, the degrading fluid or fluid that creates the degrading conditions can be filled into the base pipe and/or into the wellbore around the screen to degrade the degradable material and open the screen assembly 200 to flow.

The degradable materials provide a multitude of functions. For example, the degradable material can eliminate the need to treat the drilling mud prior to running the screen assembly by completely protecting the screens from contamination and clogging. In addition, in instances where the degradable material is or contains an acid, it can also eliminate the need to pump an acid treatment to degrade the filtercake, because the acid of the degradable material can degrade the filtercake. Furthermore, the coating can eliminate the need to run a wash pipe by creating a low pressure barrier/conduit through the screen assembly, and enabling the screen assembly to be used as a wash pipe prior to degrading the degradable material.

Figure 2C:
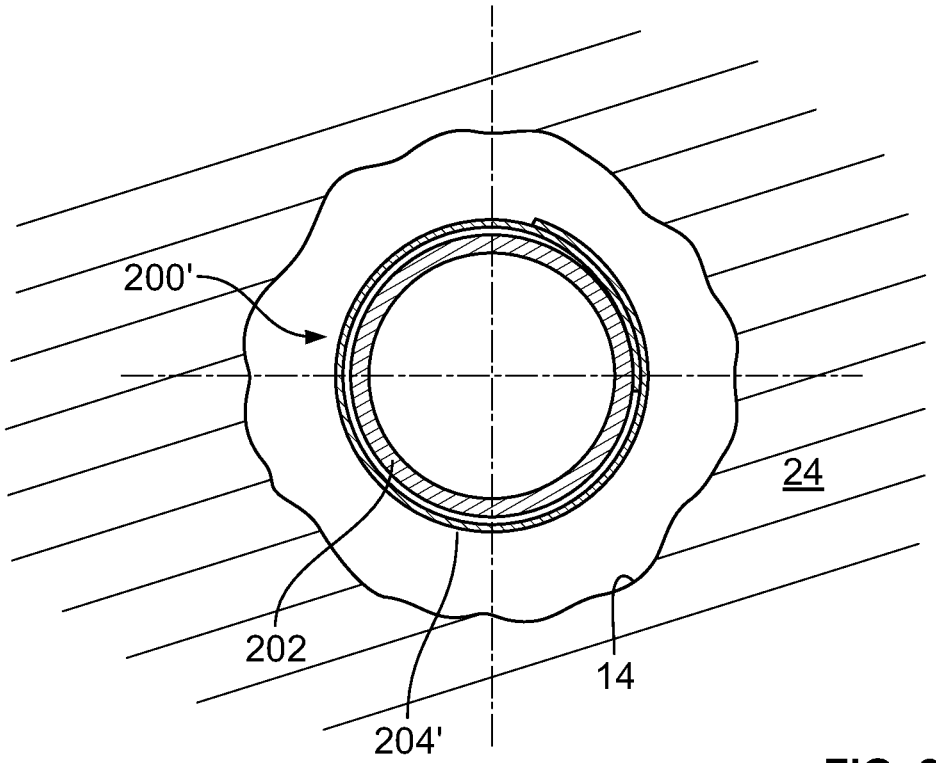
Figure 2D:
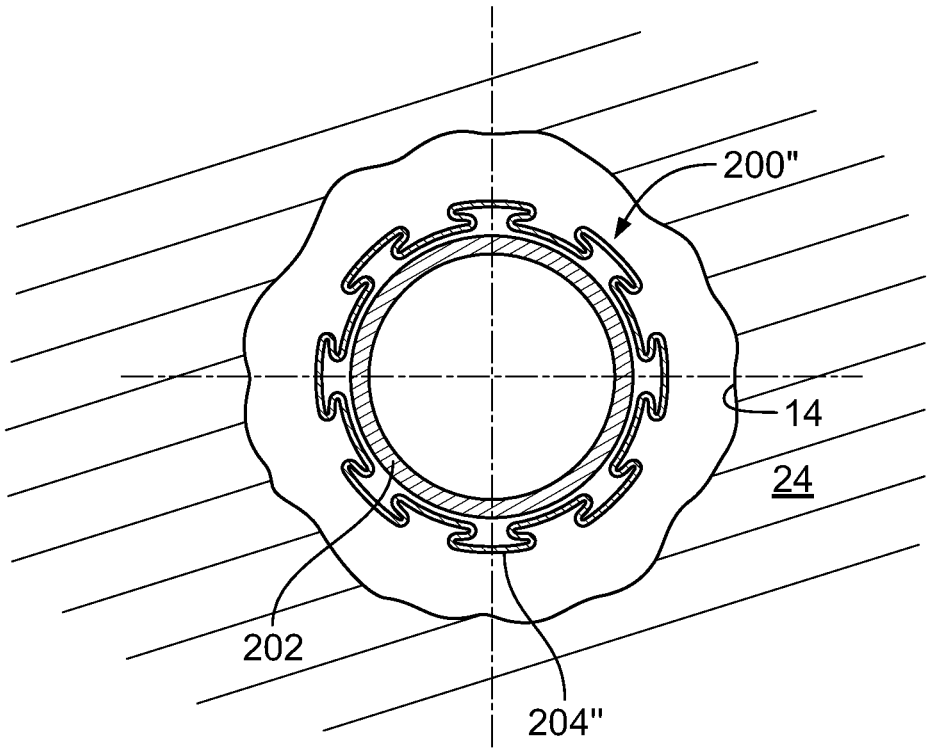

Although FIG. 2A shows the well screen 204 having axial corrugations, the screen 204 can be compacted in other manners. For example, the screen 204 could be corrugated in another manner (e.g., with circumferential or other folds). FIG. 2C shows a well screen assembly 200' like well screen assembly 200 except that the screen 204' is flat (rather than corrugated) encircling the base pipe 202 and the ends of the screen overlap. Enough screen 204' can be provided that when the screen 204' is extended to circumscribe the perimeter of the wellbore 14 the ends of the screen 204' still overlap. FIG. 2D shows another well screen assembly 200" like well screen assembly 200 except that the screen 204" has squat, T-shaped crimps defining the corrugations of the screen 204". As above, when extended the screen 204" can include enough screen material to circumscribe the perimeter of the well bore 14.

Figure 2E:
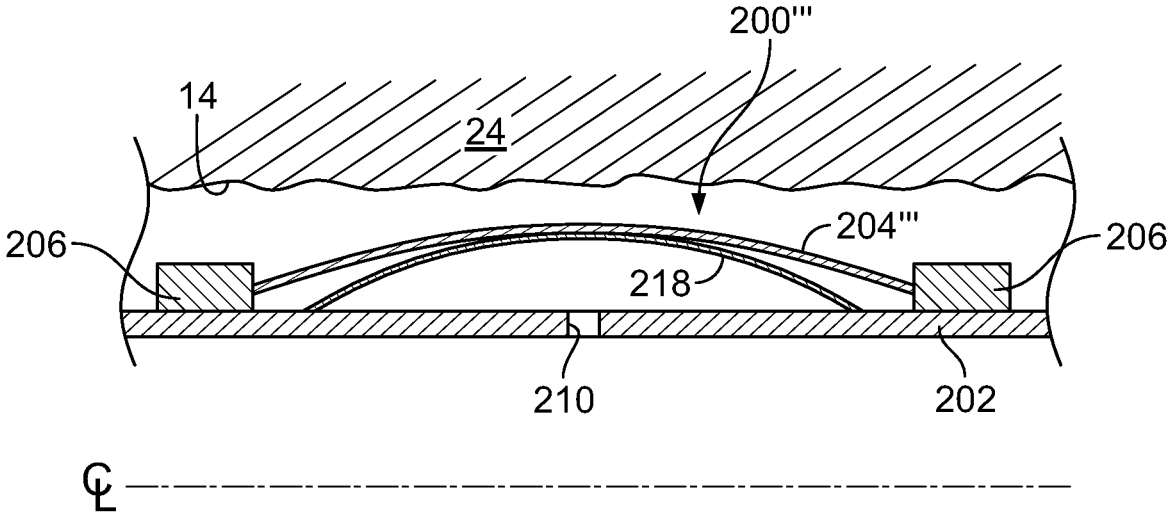
Figure 2F:
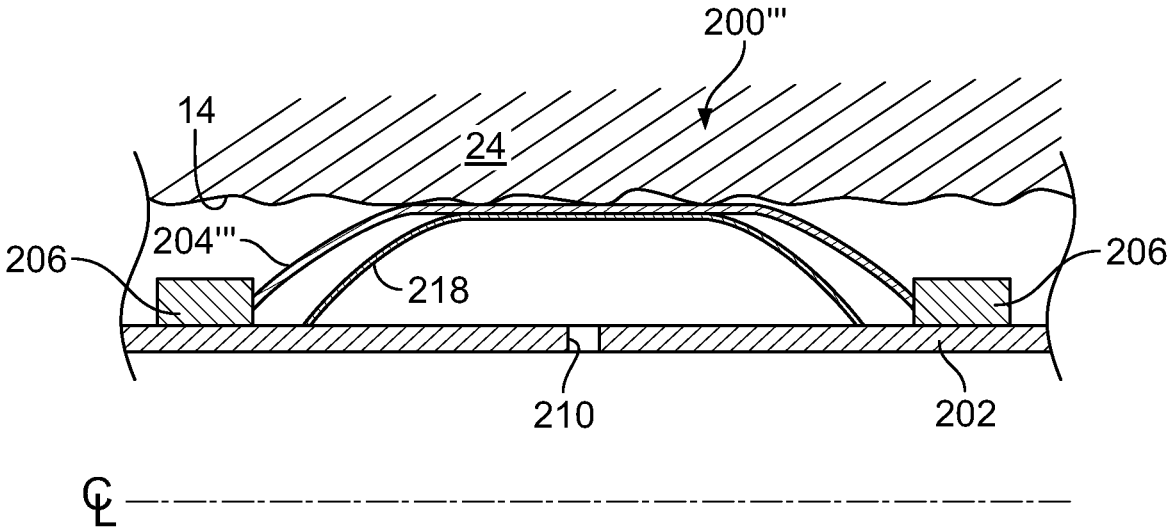

In yet another configuration FIG. 2E, the well screen assembly 200''' (shown in a quarter, side cross-sectional view) is like well screen 200 except that it includes one or more bladders 218 between the base pipe 202 and screen 204''' that can be used to extend the screen 204'''. The bladders 218 internally define an inflatable fluid cavity. The screen 204' can be corrugated as described above, flat and overlapping as described above and/or can otherwise be configured to extend. The bladder 218 can encircle the entire circumference of the base pipe 202 or can be one or more separate elongate bladders arranged on the exterior of the base pipe 202. The base pipe 202 has one or more apertures 210 that communicate the center bore of the base pipe 202 and the interior of the bladder 218. With the well screen assembly 200' in position in the wellbore 14, fluid is supplied through the center bore the base pipe 202 into the bladder 218 via the aperture 210 to supply fluid into the bladder 218 to extend the screen 204'''. The apertures communicating with the interior of the screen 204' (and not the bladders 218) can be initially plugged (e.g., by a plug, rupture disk, valve or otherwise) when the well screen assembly 200' is run into the well to focus all fluid flow to the interior of the bladders 218. Thereafter, the plugs can be opened.

In certain instances, the apertures 210 can include a valve (e.g., a check valve) that retains the fluid in the bladder 218 and maintains the bladder 218 and screen 204''' extended. In certain instances, the fluid used in extending the bladder 218 can be a solidifying material that is injected into the bladder 218 as a liquid and solidifies (entirely or substantially, e.g.

thicken) and remains in the bladder 218, maintaining the bladder 218 extended. When solidified, it cannot pass back through the apertures 210 into the center bore of the base pipe 202'''. Some examples of solidifying materials include extending foam, resin, gravel slurry, cement, gels, hydrating materials, swellable materials, crosslinking materials and/or other material. The material can be selected to solidify after a specified time, in response to temperature, in response to an activating fluid and/or in another manner. In certain instances, the bladder 218 can be constructed of a material that, when extended, maintains its extended state after the pressure is removed and supports the screen 204''' extended. For example, the bladder 218 can be metal, polymer, a metal reinforced polymer, a fiber reinforced polymer and/or another material. In certain instances, the material can plastically deform when expanded to maintain the screen 204''' extended. In certain instances, the bladder 218 can be a memory material (e.g., memory metal) deformed from an initial state into a radially compact state (e.g., as in FIG. 2E) and configured to return to the initial state in response to a stimulus (e.g., heat). In certain instances, the initial state can be a diameter equal or slightly smaller or larger than the diameter of the wellbore as in FIG. 2F, so that when the memory metal is returned to its initial state, it maintains the screen 204'' extended.

In certain instances, the bladder 218 can be constructed of rubber and/or a degradable material. The degradable material is a material that degrades in response to a specified stimulus and may or may not be the same as or related to the degradable material discussed above. The degradable material can be selected to degrade in response to certain fluids (e.g., the actuating fluid and/or another fluid) and/or when exposed to certain conditions, such as a specified temperature and/or pressure (e.g., high temperatures associated with steam injection). For example, the bladder 218 can be degraded in response to an acid and/or other fluid. Using a bladder 218 made of a degradable material allows the bladder 218 to be degraded after the screen has been extended by fluid, so as not to obscure flow between the screen and the base pipe.

In each of these embodiments, FIG. 2A-2F, the well screen can be configured to be rigid enough, that once extended by fluid, it maintains the screen in contact with the wall of the wellbore 14 even after the fluid pressure has been removed. For example, the screen can include one or more layers of pre-manufactured filtration mesh (e.g., woven, square and/or other) selected to filter against passage of particulate larger than a specified size and affixed to one or more layers of support material, such as another mesh, extendable tubing, or other support layer selected to provide rigidity to the remainder of the screen. The support material can be provided as a shroud around the exterior of the filtration mesh and/or another layer between or radially beneath the filtration mesh. In certain instances, the support material can be a memory material (e.g., memory metal) deformed from an initial state into a radially compact state (e.g., as in FIGS. 2A, 2C-2E) and configured to return to the initial state in response to a stimulus (e.g., heat). In certain instances, the initial state can be a diameter equal or slightly smaller or larger than the diameter of the wellbore as in FIG. 2B so that when the memory metal is returned to its initial state, it maintains the screen extended. In certain instances, the screen can include a fluid transport layer, such as a layer of mesh or wire that define unobstructed or relatively unobstructed axial, circumferential and/or other direction passages through the screen and facilitate transport of fluid in the plane of the screen.

Figure 3A:
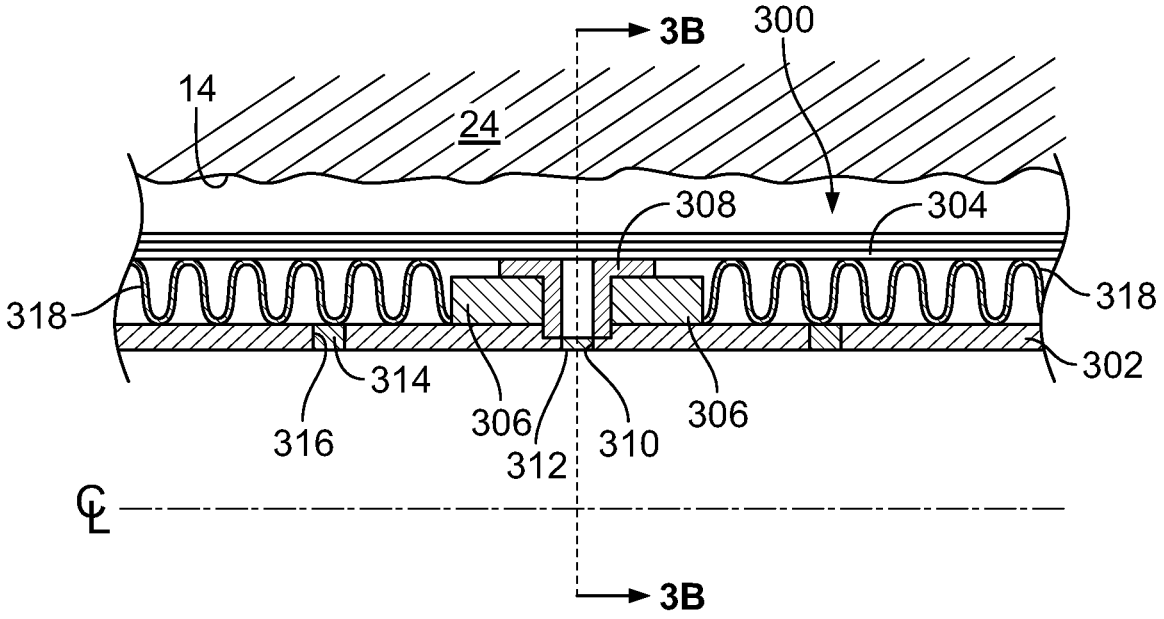
FIGS. 3A-3G are example louver type well screen assemblies having extendable filtration louvers that can be extended radially, and in certain instances, into contact with the wall of the wellbore.

FIGS. 3A-3G are example louver type well screen assemblies having extendable filtration louvers that can be extended radially, and in certain instances, into contact with the wall of the wellbore. FIG. 3A shows another configuration well screen assembly 300 that can be used as well screen assembly 100. Well screen assembly 300 is a louvered type well screen configuration. An example louver type well screen assembly configured to extend in response to contact with a specified fluid is disclosed in U.S. Patent Publication No. US 2011/0036565, entitled "Control Screen Assembly," filed Aug. 12 2009, the entirety of which is incorporated herein by reference. The well screen assembly 300 has a similar construction, but includes adaptations to extend in response to fluid pressure.

Figure 3B:
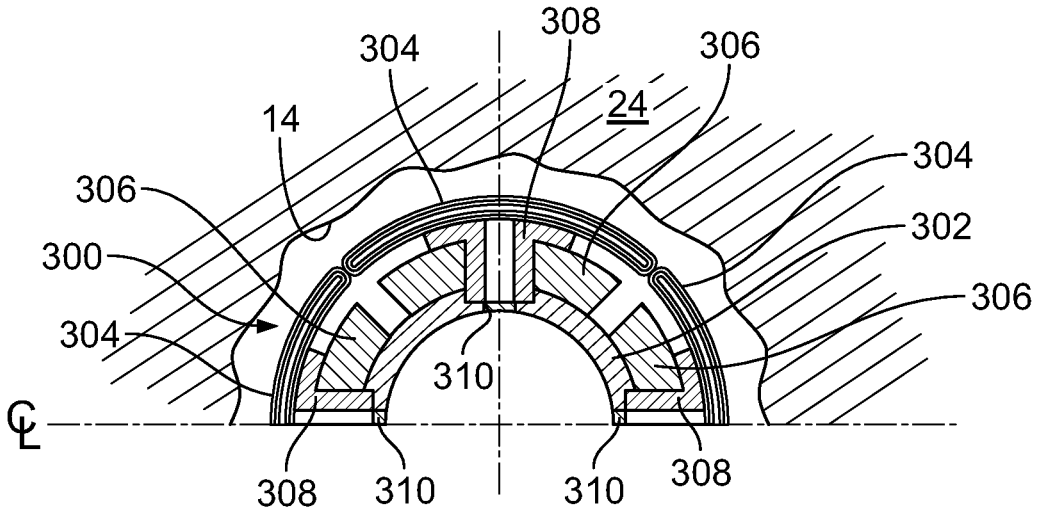
Figure 3C:
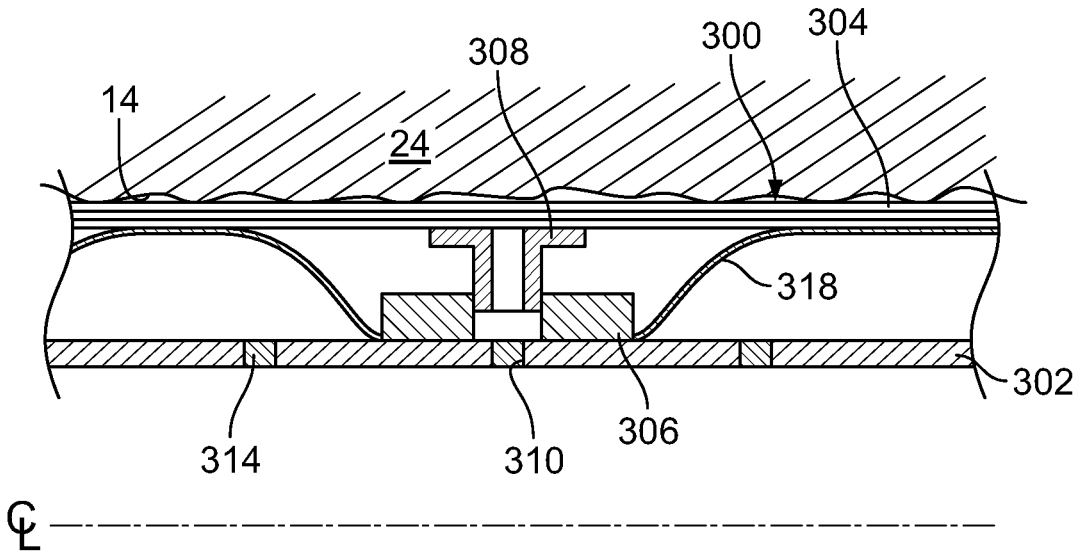

To this end, FIG. 3A is a half cross-sectional view of the well screen assembly 300 and FIG. 3B is an end cross-sectional view of the well screen assembly 300. Well screen assembly 300 has a plurality of elongate, tubular filtration mediums, i.e., filtration louvers 304, extending substantially the length of the base pipe 302. The filtration louvers 304 are defined by a filtration screen folded to define an interior longitudinal passageway through the louver. As above, the screen can include one or more layers of pre-manufactured filtration mesh (e.g., woven, square and/or other) affixed to one or more layers of support material, such as another mesh, tubing, or other support layer selected to provide rigidity to the screen. The louvers 304 can also include a fluid transport layer.

The louvers 304 are supported relative to the base pipe 302 by a plurality of telescoping passageways formed by a tubular, upper telescoping piston piece 308 affixed to the louver 304 and in fluid communication with its interior longitudinal passageway and a lower cylinder piece 306 affixed to the base pipe 302 and in fluid communication with its center bore. FIG. 3A shows the upper telescoping piece 308 as a male portion, extending into an interior, female portion of the lower telescoping piece 306. In other instances, the male and female portions could be reversed (e.g., upper piece 308 being female and lower piece 306 being male). When the well screen assembly 300 is extended, and the louvers 304 are fully extended into contact with the wall of the wellbore 14 (see FIG. 3C), the telescoping joint defines a sealed flow passage between the interior longitudinal passageway of the louver 304 and the interior of the center bore of the base pipe 302 through an aperture 310 in the base pipe 302. In certain instances, the telescoping joints can be provided near or at the ends of the louver 304 and/or at an intermediate location.

In certain instances, the screen of the louvers 304 has a degradable material, similar to that described above, embedded in its openings when the screen assembly 300 is run into the wellbore 14. Also, as above, the degradable material seals against flow through the screen and out of the louvers 304, but can later be degraded to regain flow. Alternatively, the openings of the screen can be open (without a degradable material) when the well screen assembly 300 is run into the wellbore 14, and then a degradable material is pumped into the center bore of the base pipe 302. The degradable material lodges in the openings of the screen sealing against flow through the screen of the louvers 304. In either instance, the louver 304 sealed by the degradable material defines an inflatable fluid cavity between the louver 304 and the base pipe 302 that allows fluid to act on and extend the louvers 304. Also, in lieu of the degradable material or in combination with the degradable material, a plug can be provided in the upper telescoping piece 308 to define an inflatable fluid cavity.

Thus, to extend the louvers 304 into contact with the wall of the wellbore 14, fluid pressure is supplied down the center bore of the base pipe 302 to push the louvers 304 radially outward (by filling the fluid cavity). Then, the louvers 304 are changed to allow flow therethrough by degrading the degradable material or by raising the pressure in the center bore of the base pipe 302 high enough to dislodge the plug.

In certain instances, one or more bladders 318 are provided between the base pipe 302 and the louvers 304. As above, the bladders 318 define an inflatable fluid cavity between the louver 304 and the base pipe 302 that fluid can be supplied into to extend the louvers 304. The bladder 318 can encircle the base pipe 302 between the telescoping passageways and/or can be one or more separate elongate bladders arranged axially on the exterior of the base pipe 302. The bladder 318 can be corrugated having undulations that extend axially, circumferentially or otherwise. In this instance, the base pipe 302 includes a plurality of apertures 316 radially beneath and in communication with the interior of the bladders 318. In certain instances, multiple apertures 316 are arranged circumferentially spaced apart around the circumference of the base pipe 302. The apertures 310 (communicating with the telescoping passageways) and the apertures 316 (communicating with the interior of the bladder 318) are initially sealed with plugs 312, 316. The plug 312 in the aperture 310 is configured to hold a higher pressure than the plugs 314 in the apertures 316. In certain instances, the plugs 312, 316 can be rupture disks selected to rupture at a specified pressure.

To extend the louvers 304 into contact with the wall of the wellbore 14, fluid pressure is supplied down the center bore of the base pipe 302 to rupture the plugs 314 to open flow to the interior of the bladders 318. In certain instances, the pressure is less than the rupture pressure of the plugs 312 sealing the telescoping passageway, so that the louvers 304 stay sealed and no fluid is lost to the annulus via the louvers 304. The fluid fills the bladder 318 and lifts the louvers 304 radially into contact with the wall of the wellbore 14.

Figure 3D:
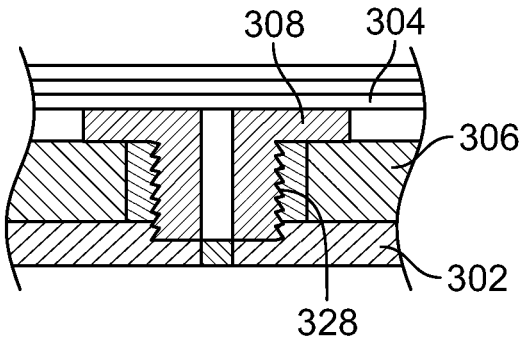
Figure 3E:
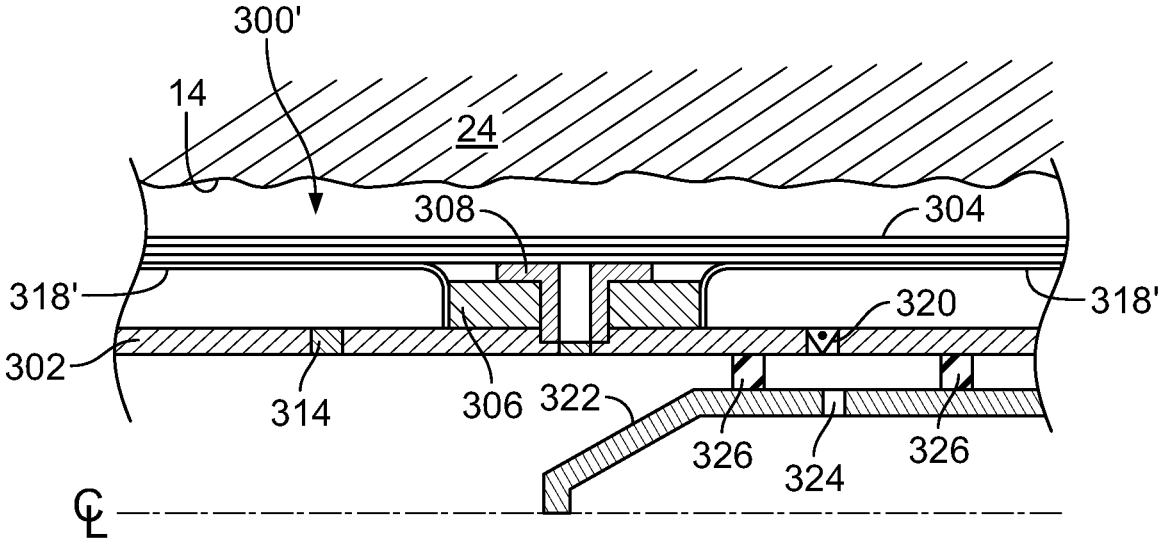
Figure 3F:
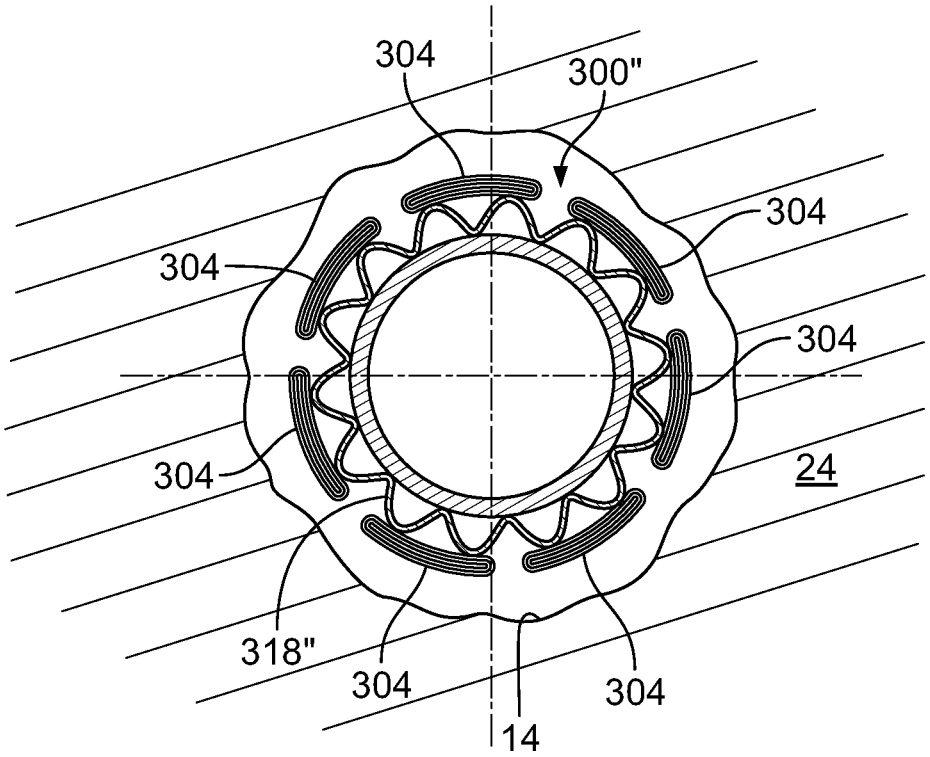
Figure 3G:
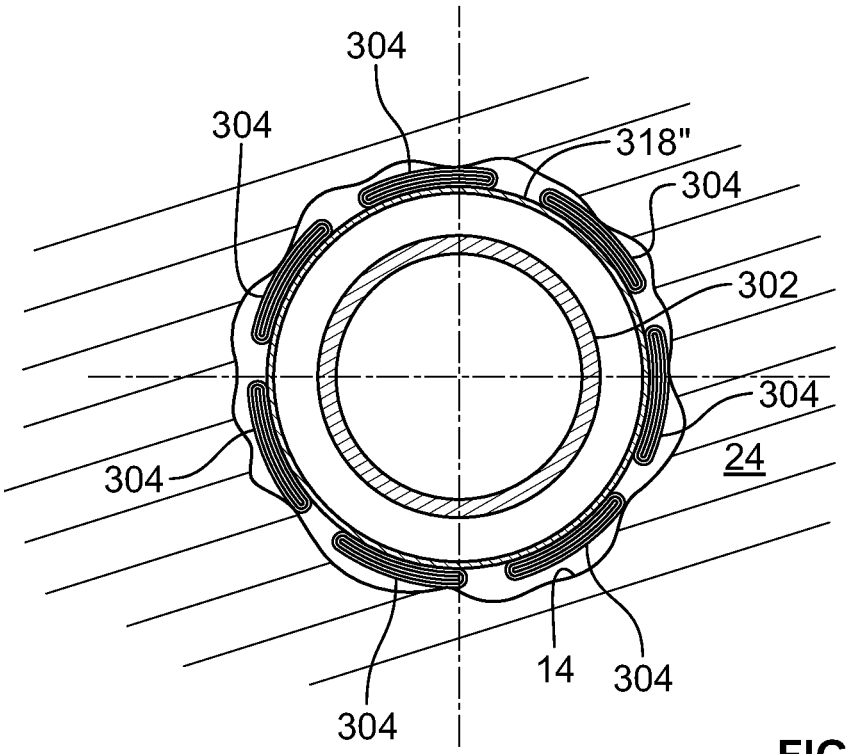

In each of the embodiments, FIGS. 3A-3G, the well screen can be configured to, once extended by fluid, maintain the louvers 304 in contact with the wall of the wellbore 14 even after the fluid pressure has been removed. For example, in certain instances, the apertures 316 can include a valve (e.g., a check valve 320) as the plug 314 that allows fluid to flow into the bladder 318, but retains the fluid in the bladder 318, and thus maintain the bladder 318 extended. In certain instances, the fluid used in extending the bladder 318 (provided with or without valves in the apertures 316) can be a solidifying material that is injected into the bladder 318 as a liquid and solidifies (entirely or substantially). When solidified, it cannot pass back through the apertures 316 into the center bore of the base pipe 302 and remains in the bladder 318, maintaining the bladder 318 extended. The material can be selected to solidify after a specified time, in response to temperature, in response to an activating fluid and/or in another manner. In certain instances, the bladder 318 can be constructed of a material that, when extended, maintains its extended state after the pressure is removed and supports the louvers 304 in contact with the wall of the wellbore 14. For example, the bladder 318 can be metal, polymer, a metal reinforced polymer, a fiber reinforced polymer and/or another material. In certain instances, the bladder 218 can be a memory material (e.g., memory metal) deformed from an initial state into a radially compact state (e.g., as in FIG. 3A) and configured to return to the initial state in response to a stimulus (e.g., heat). In certain instances, the initial state can be sized to hold the louvers at a diameter equal or slightly smaller or larger than the diameter of the wellbore as in FIG. 3C so that when the memory metal is returned to its initial state, it maintains the louvers extended. In certain instances, as shown in FIG. 3D, the upper telescoping piston piece 308 and lower cylinder piece 306 of the telescoping passageways can include a ratchet mechanism 328 configured to allow the telescopic passageway to telescope radially outward but prevent the telescopic passageway from collapsing back inward after the fluid pressure is removed (and the bladders deflated). In certain instances, the ratchet mechanism 328 includes one or more laterally extendable and retractable teeth on the piston piece 308 and/or the cylinder piece 306 that spring open and grip the other piece as the telescoping passageway is extended. In certain instances, the ratchet mechanism may be provided apart from the telescoping passageways, for example, in a separate structure. In certain instances, another mechanism can be provided to allow the telescoping passageways to telescope radially outward but not collapse back inward. For example, a swellable rubber can be provided between the piston piece 208 and cylinder piece 306. The swellable rubber is configured to swell in response to contact with certain fluids (e.g., the actuating fluid and/or another fluid) and/or when exposed to certain conditions, such as a specified temperature and/or pressure (e.g., high temperatures associated with steam injection). Thus, after the telescoping passageways radially extend, the swellable rubber is caused to swell and grip the cylinder piece 306 to the piston piece 208 and prevent the telescoping passageways from collapsing back radially inward.

In certain instances, the bladder 318 can be constructed of rubber and/or a degradable material. The degradable material can be selected to degrade in response to certain fluids (e.g., the actuating fluid and/or another fluid) and/or when exposed to certain conditions, such as a specified temperature and/or pressure (e.g., high temperatures associated with steam injection). For example, the bladder 318 can be degraded in response to an acid and/or other fluid. Using a bladder 318 made of a degradable material allows the bladder 318 to be degraded after the screen has been extended by fluid, so as not to obscure flow between the screen and the base pipe.

In certain instances, the fluid pressure can be applied to the well screen assembly 300 by pressurizing the center bore of the base pipe 302. In certain instances, shown in FIG. 3E, a tubing string of jointed and/or coiled tubing with a hydraulic injection tool 322 run in center bore of the base pipe 302 can be used to apply the fluid. The hydraulic injection tool 322 is tubular and has one or more seals 326 around an aperture 324 (e.g., a seal encircling the aperture 324, a pair of seals—one uphole and one downhole—encircling the body of the injection tool 322, and/or another configuration) that communicates between the interior center bore of the injection tool 322 and the exterior of the tool 322. The seals 326 seal against the interior wall of the base pipe 302.

The injection tool 322 can be run into the interior of the well screen assembly 300 and positioned with the seals 326 spanning and sealing the aperture 316 to aperture 324. Then, hydraulic fluid is supplied down the interior of the injection tool 322 into the bladder 318. In instances having more than one bladder 318, the injection tool 322 can be configured to supply fluid to a specific one or more or all of the bladders 318 concurrently. If multiple well screen assemblies 300 are provided in the well, the hydraulic injection tool 322 can be configured to supply fluid to one or more well screen assemblies 300 at a time. Thus, the injection tool 322 can enable actuation of specific well screen assemblies 300 and not others when multiple well screen assemblies 300 are provided. Notably, an injection tool 322 can be used with any of the configurations of well screen assembly described herein.

A number of implementations have been described. Nevertheless, it will be understood that various modifications may be made. Accordingly, other implementations are within the scope of the following claims.

What is claimed is:

1. A method comprising:

providing a well screen assembly in a well bore, the well screen assembly comprising a base pipe, and three or more filtration screens radially placed about the base pipe, the three or more filtration screens having three or more associated telescoping pistons providing a sealed flow passage between the three or more filtration screens and an interior center bore of the base pipe via three or more associated production apertures in the base pipe; and radially extending the three or more filtration screens by force from fluid supplied through separate extension apertures in the base pipe as the three or more associated telescoping pistons telescope radially outward while maintaining the base pipe radially unextended.

2. The method of claim 1, where radially extending the three or more filtration screens with force from fluid pressure comprises supplying fluid into one or more bladders between the three or more filtration screens and the base pipe.

3. The method of claim 2, comprising, after radially extending the three or more filtration screens, degrading the bladder.

4. The method of claim 2, comprising maintaining the screen radially extended by plastically deforming the bladder.

5. The method of claim 1 where radially extending the three or more filtration screens with force from fluid pressure comprises supplying fluid into a center bore of the base pipe.

6. The method of claim 1, where radially extending the three or more filtration screens comprises extending the three or more filtration screens into contact with a wall of the well bore.

7. The method of claim 1, where radially extending the three or more filtration screens comprises inserting an injection tool into the center bore of the base pipe.

8. The method of claim 1, comprising maintaining the three or more filtration screens radially extended with a foam, resin, gravel slurry, or cement supplied between the base pipe and the three or more filtration screens.

9. The method of claim 1, comprising maintaining the screen radially extended with a ratchet mechanism.

10. The method of claim 1, where the screen is a filtration louver.

11. The method of claim 1, where radially extending the three or more filtration screens with force from fluid pressure while maintaining the base pipe radially unextended comprises extending the three or more filtration screens without plastically deforming the base pipe.

12. A well screen assembly, comprising:

a base pipe; and three or more filtration screens radially placed about the base pipe, the three or more filtration screens having three or more associated telescoping pistons providing a sealed flow passage between the three or more filtration screens and an interior center bore of the base pipe via three or more associated production apertures in the base pipe, the three or more filtration screens adapted to radially extend from a radially unextended state to a radially extended state in response to force from fluid pressure supplied through separate extension apertures in the base pipe while the base pipe remains radially unextended.

13. The well screen assembly of claim 12, comprising one or more bladders between the base pipe and the three or more filtration screens adapted to extend the three or more filtration screens to the radially extended state when fluid is supplied into the one or more bladders.

14. The well screen assembly of claim 13, where the bladder is adapted to plastically deform and maintain the screen in the radially extended state.

15. The well screen assembly of claim 14, where the screen comprises a degradable material embedded in openings of the screen and sealing against flow through the screen.

16. The well screen assembly of claim 12, where the screen is a filtration louver.

17. The well screen assembly of claim 12, where the three or more filtration screens comprise a support layer adapted to plastically deform and maintain the three or more filtration screens in the extended state.

18. A well screen assembly, comprising:

one or more inflatable fluid cavities defined radially beneath three or more filtration screens radially placed about a base pipe, the three or more filtration screens having three or more associated telescoping pistons providing a sealed flow passage between the three or more filtration screens and an interior center bore of the base pipe via three or more associated production apertures in the base pipe, the one or more inflatable fluid cavities configured to receive fluid supplied through separate extension apertures in the base pipe to extend the three or more filtration screens radially when fluid is supplied into the one or more inflatable fluid cavities.

19. The well screen assembly of claim 18, where the one or more inflatable fluid cavities comprise one or more bladders.

* * * * *